US005865484A

United States Patent [19]

Johns

[11] Patent Number: 5,865,484

[45] Date of Patent: Feb. 2, 1999

[54] DOOR LOCKING DEVICE

[76] Inventor: Blair E. Johns, 3918 W. Coronado, Phoenix, Ariz. 85009

[21] Appl. No.: 717,853

[22] Filed: Sep. 23, 1996

[51] Int. Cl.[6] ..... E05C 19/18

[52] U.S. Cl. ..... 292/288; 292/297; 292/298

[58] Field of Search ..... 292/288–298, 292/285, 210

[56] References Cited

U.S. PATENT DOCUMENTS

| | | | |
|---|---|---|---|
| 196,810 | 11/1877 | Kerlicks | 292/293 |
| D. 317,111 | 5/1991 | Johns . | |
| 456,267 | 7/1891 | Davis . | |
| 721,045 | 2/1903 | Keller . | |
| 1,176,859 | 3/1916 | Sautter | 292/298 |
| 1,429,536 | 9/1922 | Robinson | 292/291 |
| 1,477,731 | 12/1923 | Ulrich | 292/294 |
| 2,161,673 | 6/1939 | Hammond | 292/290 |
| 3,815,945 | 6/1974 | Lamphere . | |
| 3,963,269 | 6/1976 | Rosenberg . | |
| 4,195,870 | 4/1980 | Percoco . | |
| 4,326,394 | 4/1982 | Stein . | |
| 4,387,919 | 6/1983 | Quaintance | 292/296 |
| 4,399,672 | 8/1983 | Moorhouse | 292/289 |
| 4,506,527 | 3/1985 | Grill . | |
| 4,629,231 | 12/1986 | Bouchard . | |
| 5,135,272 | 8/1992 | Centofante | 292/293 |
| 5,547,236 | 8/1996 | Gregory | 292/288 |

OTHER PUBLICATIONS

Universal Temporary Locks™ Distributor Price List (4 pages); Modern Manufacturing; Jul. 1988.

*Primary Examiner*—Steven Meyers
*Assistant Examiner*—Gary Estremsky
*Attorney, Agent, or Firm*—Leydig, Voit & Mayer, Ltd.

[57] ABSTRACT

A door locking device is provided for positionally constraining an outwardly opening door against a stop of a cooperating door frame. The door locking device includes a door engaging member attached to the free-end of the door (i.e., the unhinged-end of the door), a threaded shaft having a first end pivotably mounted to the door engaging member and a second end opposite the first end for manual pivotal movement between an unlocked position (i.e., a position wherein the threaded shaft forms an acute angle with respect to the door) and an locked position (i.e., a position wherein the threaded shaft forms an obtuse angle with respect to the door), a wedge member slidably mounted on the threaded shaft, and a retaining nut disposed on the threaded shaft for axial movement thereon. In use, the door is positionally constrained against the stop of the door frame by closing the door, by moving the threaded shaft into the locked position, and by advancing the retaining nut along the threaded shaft until the retaining nut and the wedge member achieve a securing position (i.e., a position wherein the wedge member is immovably wedged between the retaining nut and the stop of the door frame). In order to bias the threaded shaft in the locked and unlocked positions, respectively, the door locking device may further include a cam member disposed on the first end of the threaded shaft and a spring member attached to the door engaging member for cooperative engagement with the cam member.

13 Claims, 4 Drawing Sheets

DOOR LOCKING DEVICE

FIELD OF THE INVENTION

The present invention relates generally to door locks and, more particularly, to a door locking device for positionally constraining an outwardly opening door against a cooperating door frame.

BACKGROUND OF THE INVENTION

In order to provide convenient access to a structure (e.g., a building), doors are frequently installed into the walls thereof. Many doors also have a cooperating door frame with a stop which prevents the door from swinging past the plane of the door frame (i.e., the plane of the wall). For example, if the door is located inboard of the stop, the door will open inwardly (i.e., toward the interior of the structure), but not outwardly (i.e., toward the exterior of the structure). If the door is located outboard of the stop, however, it will open outwardly, but not inwardly. Such outwardly swinging doors are commonly referred to as "exit only doors." Of course, if no stop is provided, the door will open both inwardly and outwardly.

At construction sites, movie theaters, and the like, it is often necessary to positionally constrain (or lock) an exit only door from the inside so that unauthorized entry from the outside is prevented. Although attempts have been made to accomplish this feat, these attempts have proven deficient in many respects. For instance, the door lock devices used at most movie theaters are cumbersome, complicated, and expensive. Such door lock devices also have many parts which makes them difficult to assemble, disassemble, and repair. Moreover, it is often times desirable to provide such door lock devices without padlocks, key operated locking mechanisms, or the like so that the door may be quickly opened from the inside for emergency egress.

OBJECTS OF THE INVENTION

Accordingly, a general object of the present invention is to provide a door locking device for an outwardly opening door (i.e., an exit only door) which positionally constrains the door against a cooperating door frame.

Another object of the present invention is to provide a door locking device for an outwardly opening door that permits the door to be positionally constrained from the inside.

A related object of the present invention is to provide a door locking device for an outwardly opening door that can be quickly and easily opened from the inside for emergency egress.

A further related object of the present invention is to provide a door locking device for an outwardly opening door that prevents unauthorized entry from the outside.

An additional object of the present invention is to provide a door locking device for an outwardly opening door which includes a small number parts and is of unitary construction.

Still another object of the present invention is to provide a door locking device for an outwardly opening door that may be conveniently attached to the door by frictional engagement.

Yet another object of the present invention is to provide a door locking device for an outwardly opening door which is simple and relatively inexpensive to manufacture, and is also reliable, easy, and convenient to use.

These and other objects, features, and advantages of the present invention will become apparent upon reading the following detailed description of a preferred exemplified embodiment and upon reference to the accompanying drawings.

SUMMARY OF THE INVENTION

The above objects are accomplished by providing a door locking device for positionally constraining an outwardly opening door against a stop of a cooperating door frame. In particular, the door locking device of the present invention includes a door engaging member attached to the free-end of the door (i.e., the unhinged-end of the door), a threaded shaft having a first end pivotably mounted to the door engaging member and a second end opposite the first end for manual pivotal movement between an unlocked position (i.e., a position wherein the threaded shaft forms an acute angle with respect to the door) and an locked position (i.e., a position wherein the threaded shaft forms an obtuse angle with respect to the door), a wedge member slidably mounted on the threaded shaft, and a retaining nut disposed on the threaded shaft for axial movement thereon. In use, the door is positionally constrained against the stop of the door frame by closing the door, by moving the threaded shaft into the locked position, and by advancing the retaining nut along the threaded shaft until the retaining nut and the wedge member achieve a securing position (i.e., a position wherein the wedge member is immovably wedged between the retaining nut and the stop of the door frame).

In order to bias the threaded shaft in the locked and unlocked positions, respectively, the door locking device may further include a cam member disposed on the first end of the threaded shaft and a spring member attached to the door engaging member for cooperative engagement with the cam member. In use, the threaded shaft is movable from the unlocked and locked positions when a moment sufficient to overcome the biasing of the spring member is applied thereto.

BRIEF DESCRIPTION OF THE DRAWINGS

In the drawings, wherein similar reference numerals denote similar elements throughout the several views.

Figure 1:
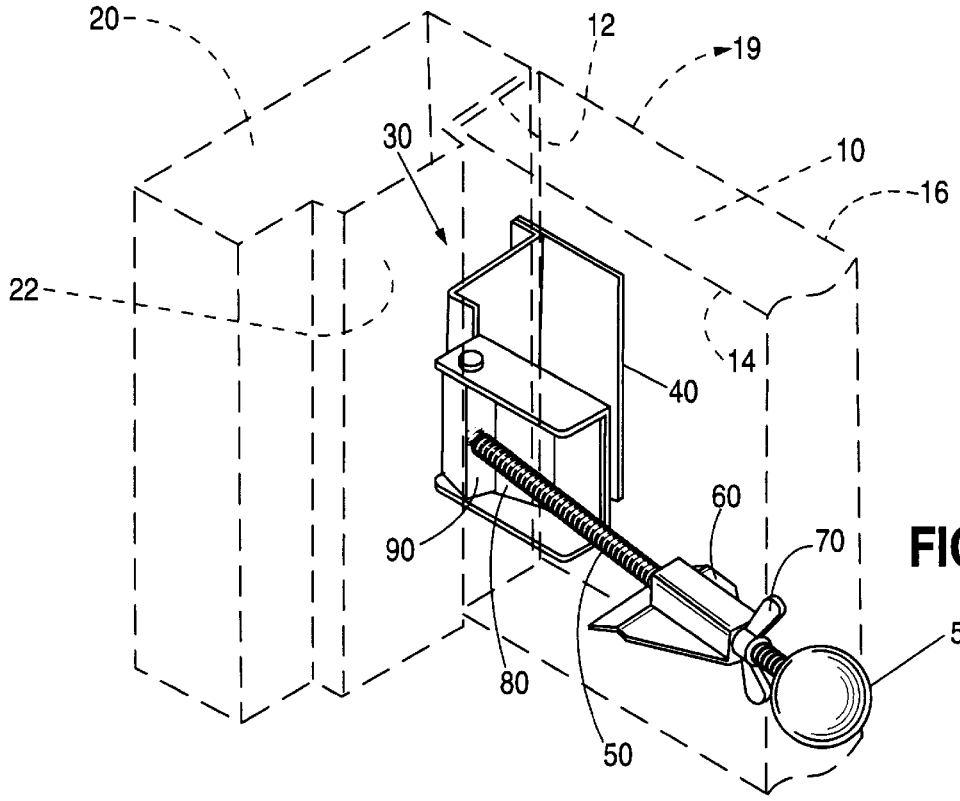
FIG. 1 is a perspective view of a door, a cooperating door frame, and a door locking device constructed in accordance with the teachings of the present invention, here showing the threaded shaft of the door locking device in an unlocked position.

While the present invention will be described and disclosed in connection with certain preferred embodiments and procedures, the intent is not to limit the present invention to these specific embodiments. On the contrary, the intent is to cover all such alternatives, modifications, and equivalents that fall within the spirit and scope of the present invention as defined by the appended claims.

DETAILED DESCRIPTION OF THE PREFERRED EMBODIMENT

Turning now to the drawings, a door locking device construct ed in accordance with the teachings of the present invention is generally designated by reference numeral 30. As shown somewhat diagramatically in FIGS. 1–3, the door locking device 30 of the present invention is intended for use with a door 10 and a cooperating door frame (or door jamb) 20. As is customary in the art, the door 10 includes a hinged-end (not shown) which is pivotably mounted with respect to a vertical side of the door frame, and a free-end 12 which engages and swings outwardly away from a stop 22 disposed along the opposite vertical side of the door frame 20. The door 10 also includes an interior (or inboard) side 14 and an exterior (or outboard) side 16.

Because the door 10 is located outboard of the stop 22, the free-end 12 thereof opens outwardly away from the door frame 20. Put another way, the stop 22 prevents the door 10 from swinging inwardly past the plane of the door frame 20. In fact, the door 10 is movable between a closed position wherein the free-end 12 engages the stop 22 of the door frame 20, as shown, for example in FIGS. 1–3, and an open position wherein the free-end 12 is spaced-apart from the stop 22 (not shown). Thus, when the door 10 is opened, the free-end 12 thereof swings outwardly away from the door frame 20 in a direction generally indicated by reference numeral 19. When the door 10 is closed, however, the free-end 12 swings inwardly until it engages the stop 22 of the door frame 20. In this way, the stop 22 of the door frame 20 prevents the door 10 from being moved inwardly (i.e., in a direction opposite to that of direction 19) past the closed position. For this reason, the door 10 (illustrated in FIGS. 1–3 of the drawings) is commonly referred to as an "exit-only door."

Figure 2:
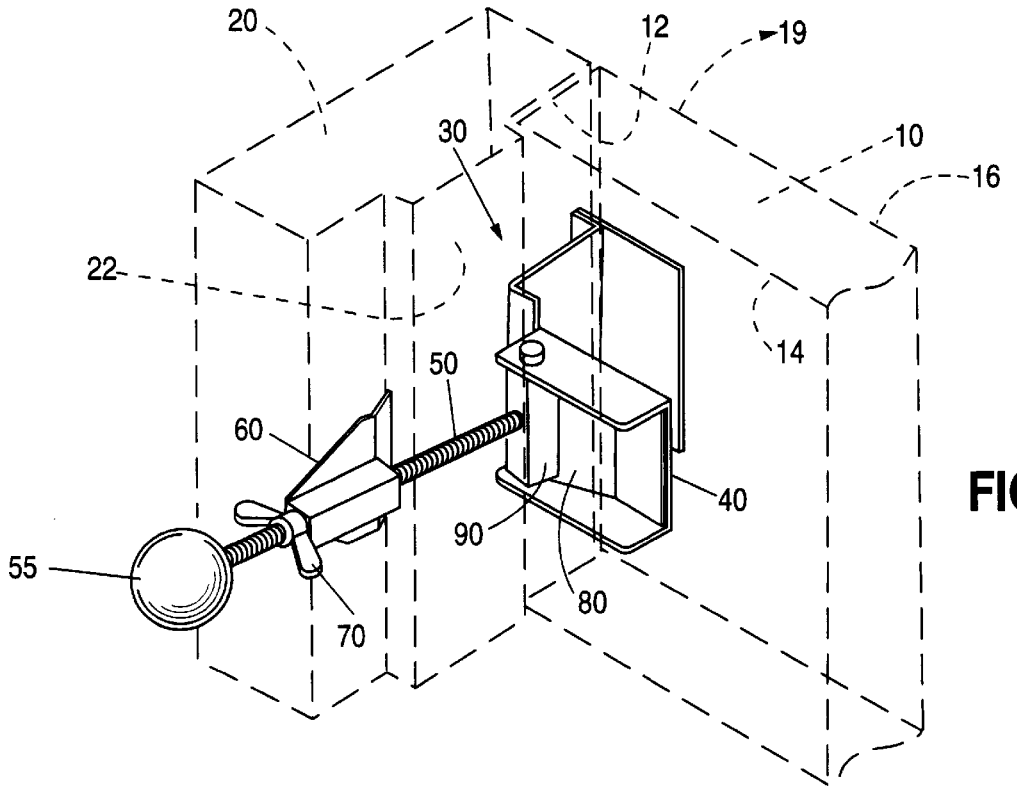
FIG. 2 is a perspective view of the door, the cooperating door frame, and the door locking device depicted in FIG. 1, here showing the threaded shaft in a locked position.
Figure 3:
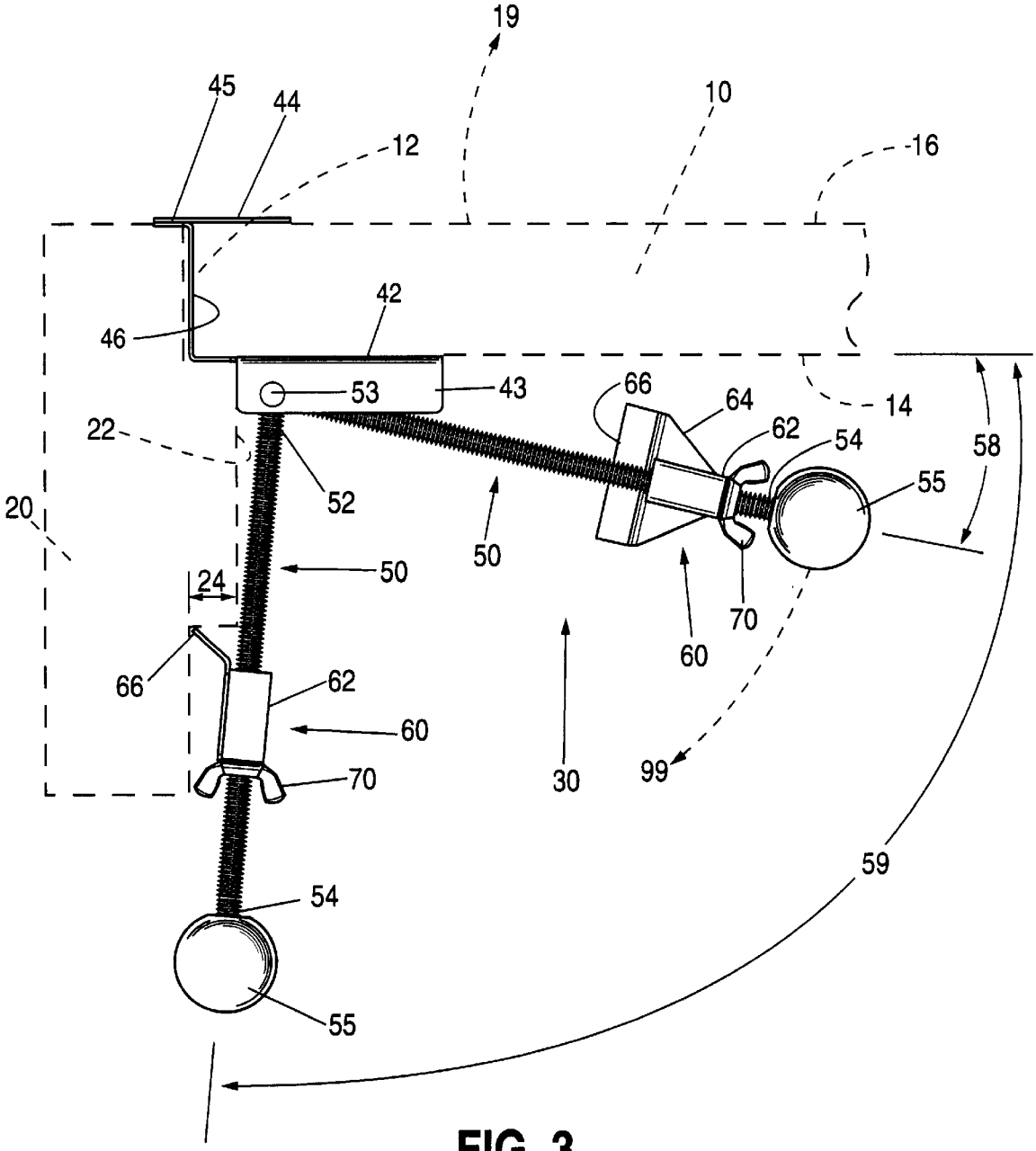
FIG. 3 is a top plan view of the door, the cooperating door frame, and the door locking device, here showing the threaded shaft in the unlocked position and the locked position, respectively.

The door locking device 30 of the present invention includes a door engaging member 40 which is attachable to the free-end 12 of the door 10. In the illustrated embodiment, the door engaging member 40 includes a first planar surface 42, a second planar surface 44 arranged substantially parallel to (but offset from) the first planar surface 42, and a third planar surface 46 arranged generally perpendicularly therebetween. As shown in FIGS. 1–3, the first planar surface 42 of the door engaging member 40 abuts the interior side 14 of the door 10, while the third planar surface 46 abuts the exterior side 16. Also, when the door 10 is in the closed position, the first planar surface 42 of the door engaging member 40 abuts the stop 22 of the door frame 20. The door engaging member 40 is preferably formed of a resilient metal material.

In keeping with an important aspect of the present invention, the first and second planar surfaces 42 and 44 are offset by a distance which is approximately equal to the width of the door 10. In this way, the door engaging member 40 may be conveniently attached to the door 10 through frictional engagement between the planar surfaces 42, 44, and 46 and the free-end 12 of the door 10. Of course, the door engaging member 40 may also be conveniently removed from the free-end 12 of the door 10 by opening the door 10 and applying a sufficient pulling force thereto.

Figure 7:
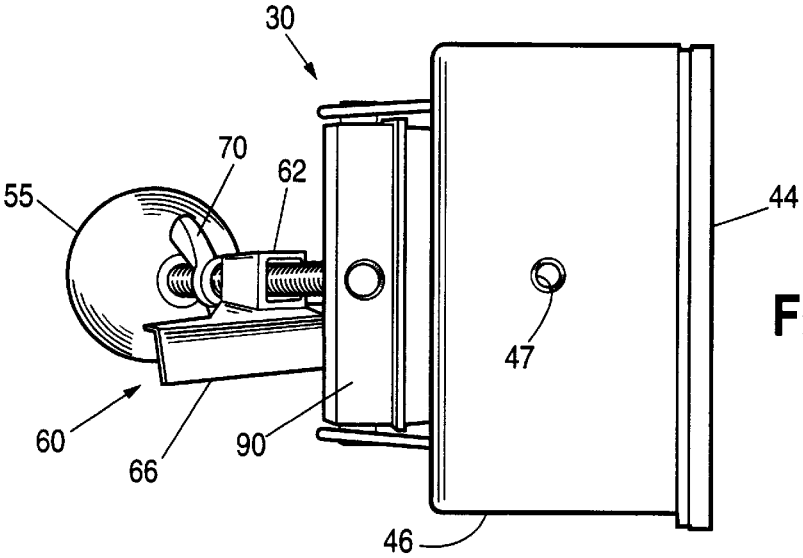
FIG. 7 is a left side elevational view thereof.
Figure 8:
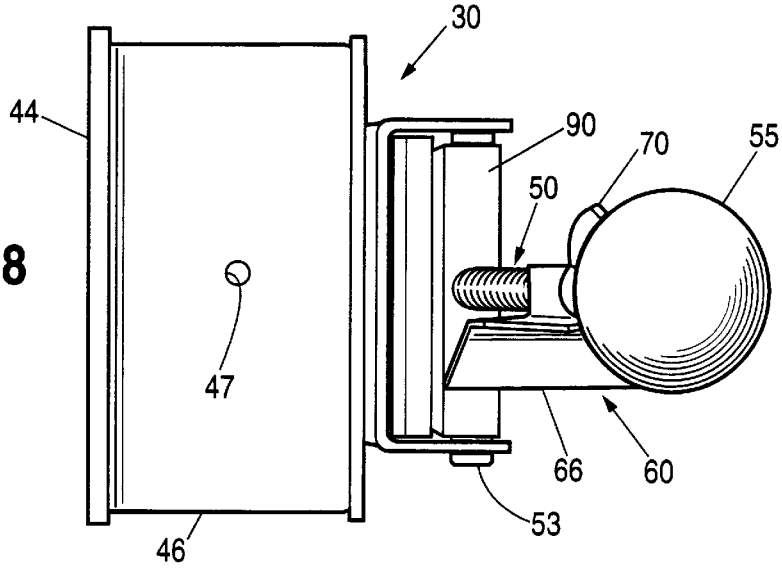
FIG. 8 is a right side elevational view thereof.

In order to provide a supplementary means of attaching the door engaging member 40 to the free-end 12 of the door 10, the third planar surface 46 may include a hole 47 formed therethrough for receiving an optional fastener (not shown), as shown, for example, in FIGS. 7 and 8. In practice, the door engaging member 40 is securely affixed to the door 10 by frictionally installing the door engaging member 40 onto the free-end 12 thereof, and by inserting a screw, a nail, or the like through hole 47 and into the door 10.

In the illustrated embodiment, the door engaging member 40 further includes a pair of spaced-apart shoulders 43 and a tab portion 45. As best shown in FIGS. 1–3, the shoulders 43 project inwardly from the first planar surface 42 (i.e., in a direction opposite to that of direction 19), while the tab portion 45 projects past the third planar surface 46 and beyond the free-end 12 of the door 10 (i.e., in a direction toward illustrated section of the door frame 20). In fact, when the door 10 is in the closed position, the tab portion 45 of the door engaging member 40 abuts the door frame 20.

The door locking device 30 of the present invention also includes a shaft 50 which is pivotably attached to the door engaging member 40. In the illustrated embodiment, the shaft 50 is threaded, as shown, for example, in FIGS. 2–6. The threaded shaft 50 also includes a first end 52 which is pivotably attached to the shoulders 43 of the door engaging member 40 via a cross member 53, and a second end opposite the first end 52. In accordance with an important aspect of the present invention, the threaded shaft 50 is arranged on the interior side 14 of the door 10. Thus, when the door 10 is in the closed position, the threaded shaft 50 is inaccessible from the exterior side 16 thereof.

As best depicted in FIG. 3, the threaded shaft 50 is manually pivotably movable between an unlocked position (i.e., a position wherein the threaded shaft 50 forms an acute angle 58 with respect to both the interior side 14 of the door 10 and the first planar surface 42 of the door engaging member 40), and an unlocked position (i.e., a position wherein the threaded shaft 50 forms an obtuse angle 59 with respect to both the interior side 14 of the door 10 and the first planar surface 42 of the door engaging member 40). In the illustrated embodiment, the locked position of the threaded shaft 50 is approximately perpendicular to the unlocked position of the threaded shaft 50. In any event, the second end 54 of the threaded shaft 50 is spaced-apart from the stop 22 of the door frame 20 when in the unlocked position (see FIG. 1), and is appreciably closer to the stop 22 of the door frame 20 when in the locked position (see FIG. 2). In order to facilitate manual movement of the threaded shaft 50 between the unlocked and locked positions, the second end 54 of the threaded shaft 50 is provided with a generally spherical knob handle 55. The handle 55 is preferably formed of a durable plastic material.

The door locking device 30 of the present invention also includes a wedge member 60 slidably mounted on the threaded shaft 50. In the illustrated embodiment, the wedge member 60 includes a four-sided sleeve portion 62 which surrounds a portion of the threaded shaft 50, and a generally triangular handle portion 64 attached to the sleeve portion 62. The handle portion 64, in turn, includes an engagement edge 66 which is adapted to engage the stop 22 of the door frame 20 when the threaded rod 50 is in the closed position, as shown, for example, in FIG. 3.

In order to maintain the engagement edge 66 of the wedge member 60 in contact with the stop 22 of the door frame 20 when the threaded rod 50 is in the closed position, the door locking device 30 of the present invention also includes a retaining nut 70 disposed on the threaded shaft 50 for axial movement between the first and second ends 52 and 54 thereof. As shown in FIGS. 1–6, the retaining nut 70 is arranged between the wedge member 60 and the second end 54 of the threaded shaft 50. In use, of course, the retaining nut 70 may be moved either toward or away from the first end 52 of the threaded shaft 50 simply by rotating the retaining nut 70 in the appropriate direction. In the illustrated embodiment, the retaining nut 70 comprises a conventional wing nut and provides a convenient means for retaining the wedge member 60 in a desired position between the first and second ends 52 and 54 of the threaded shaft 50 (i.e., in contact with the stop 22 of the door frame 20).

When the threaded shaft 50 is in the locked position, the retaining nut 70 may be advanced along the threaded shaft 50 until the retaining nut 70 and the wedge member 60 achieve a securing position (i.e., a position wherein the wedge member 60 is immovably wedged between the retaining nut 70 and the stop 22 of the door frame 20). In use, the retaining nut 70 and the wedge member 60 are preferably moved into the securing position by manually placing the engagement edge 66 of the wedge member 60 against the stop 22 of the door frame 20, and then advancing the retaining nut 70 toward the first end 52 of the threaded shaft 50 until it abuts the sleeve portion 62 of the wedge member 60. Once the retaining nut 70 and the wedge member 60 are in the securing position, the door 10 is positionally constrained against the stop 22 of the door frame 20.

Thus, in keeping with certain important objects of the present invention, the threaded shaft 50, the retaining nut 70, and the wedge member 60 of the door locking device 30 may be used to positionally constrain the outwardly opening door 10 against the stop 22 of the cooperating door frame 20 by: (1) moving the door 10 into the closed position; (2) moving the threaded shaft 50 into the locked position; and (3) moving the retaining nut 70 and the wedge member 60 into the securing position. In addition, because the threaded shaft 50, the wedge member 60, and the retaining nut 70 are all arranged on the interior side 14 of the door 10, the door locking device 30 not only prevents unauthorized entry from the exterior side 16 of the door, but also permits the door 10 to be positionally constrained from the interior side 14 thereof.

Of course, after the door 10 has been positionally constrained against the stop 22 of the door frame 20, it may thereafter be opened by: (1) moving the retaining nut 70 and the wedge member 60 away from the securing position (i.e., moving the retaining nut 70 toward the second end 52 of the threaded shaft 50 until the wedge member 60 disengages the stop 22 of the door frame 20); and (2) moving the threaded shaft 50 into the unlocked position. In certain situations, however, the door 10 may be opened without first moving the retaining nut 70 and the wedge member 60 away from the securing position. In an emergency situation, for example, the door 10 may be quickly opened simply by moving the threaded shaft 50 into the unlocked position. In such a situation, the engagement edge 66 of the wedge member 60 will scrape along distance 24 of the stop 22 of the door frame 20 until the threaded shaft 50 is freely movable into the unlocked position.

Figure 4:
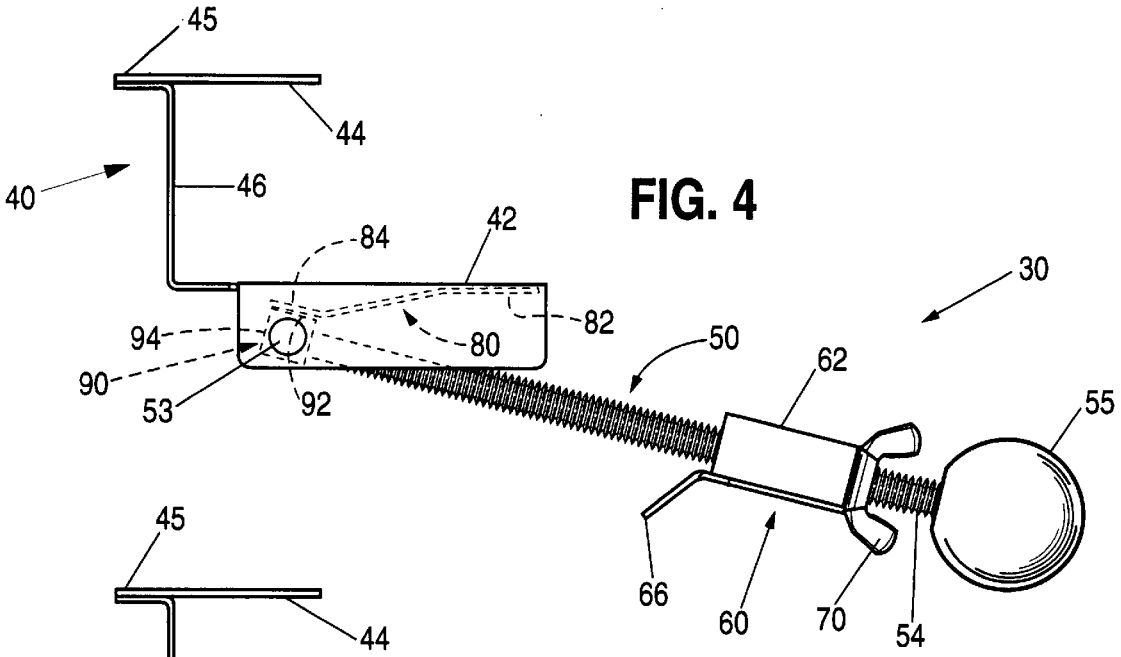
FIG. 4 is a top plan view of the door locking device, here showing the threaded shaft in the unlocked position.
Figure 5:
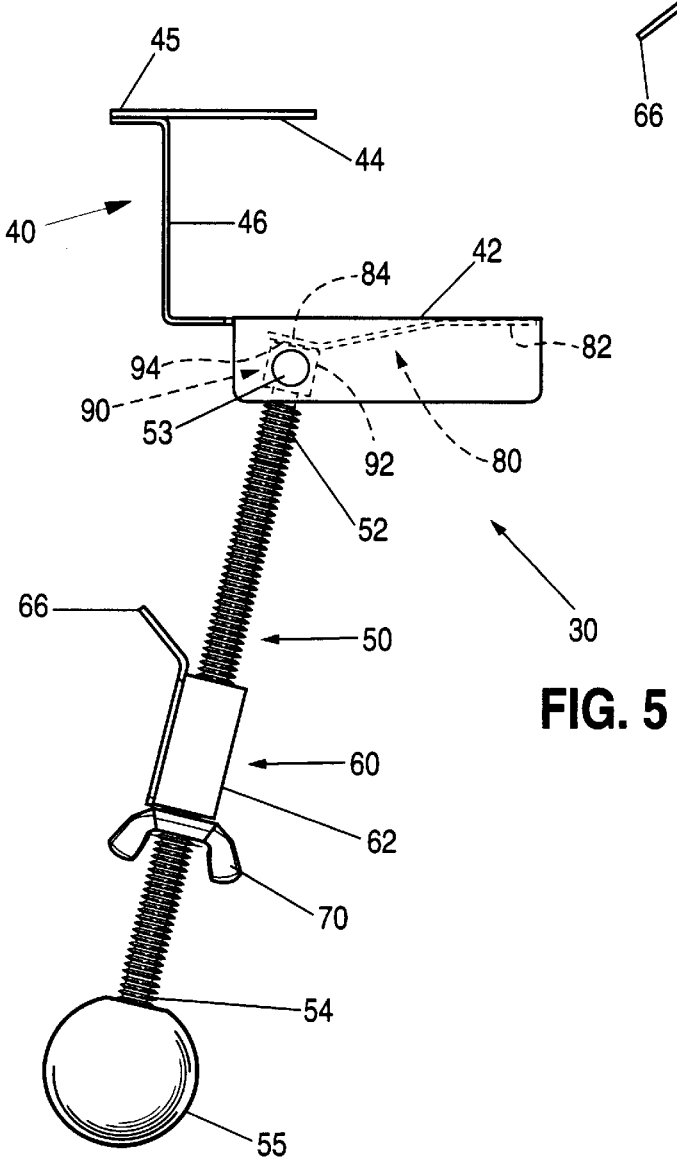
FIG. 5 is a top plan view of the door locking device, here showing the threaded shaft in the locked position.
Figure 6:
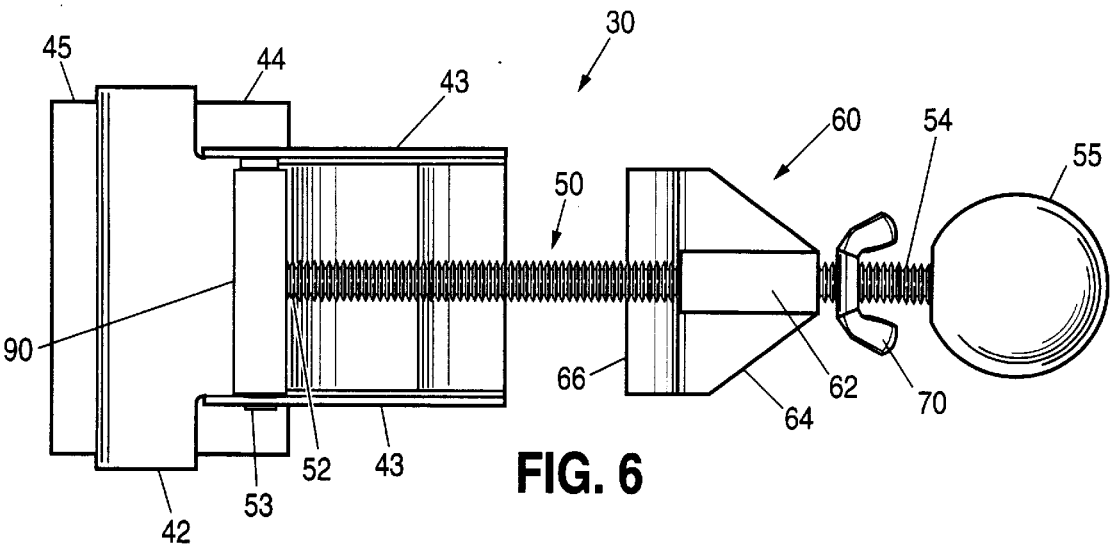
FIG. 6 is a front view of the door locking device, here showing the threaded shaft in the unlocked position.

As an added feature, the door locking device 30 of the present invention preferably includes a means for biasing the threaded shaft 50 in the unlocked and locked positions, respectively. In the illustrated embodiment, this biasing feature is provided by a spring member 80 attached to the door engaging member 40, and by a cam member 90 disposed on the first end 52 of the threaded shaft 50. As best illustrated in FIGS. 3–5, the cam member 90 surrounds cross-member 53 and has a generally rectangular parallelepiped configuration. The spring member 80, on the other hand, comprises an angled beam (or leaf) spring having a first end 82 attached to the first planar surface 42 of the door engaging member 40, and a second cantilevered end 84 which cooperatively engages the cam member 90 by exerting a force against one of the four sides thereof. This force, together with the respective geometries of the cam member 90 and spring member 80, biases the threaded shaft 50 in the locked and unlocked positions, respectively.

By way of example, when the threaded shaft 50 is in the unlocked position, the cantilevered end 84 of the spring member 80 exerts a force against a first side 92 of the cam member 90, as shown in FIG. 4, which biases the threaded shaft 50 in the unlocked position. When a sufficient moment is applied to the threaded shaft 50 in the direction indicated by reference numeral 99 in FIG. 3, however, the biasing provided by the spring member 80 is overcome and the threaded shaft 50 is movable from the unlocked position to the locked position. When the threaded shaft 50 is in the locked position, the cantilevered end 84 of the spring member 80 exerts a force against a second adjacent side 94 of the cam member 90, as shown in FIG. 5, which biases the threaded shaft 50 in the locked position. In this way, the spring member 80 and the cam member 90 conveniently biases the threaded shaft 50 in the locked and unlocked positions, respectively. The threaded shaft 50, of course, is movable from the unlocked and locked positions when a moment sufficient to overcome the biasing of the spring member 80 is applied thereto.

While the present invention has been described and disclosed with an emphasis upon a preferred embodiment, it will be understood, of course, that the present invention is not strictly limited thereto. Since modifications may be made to the structures disclosed herein—particularly in light of the foregoing teachings—without departing from the present invention, the following claims are intended to cover all structures that fall within the scope and spirit of the present invention.

What is claimed is:

1. A quick-release door locking device comprising:

a door engaging member adapted to be attached to a free-end of a door that opens in an outwardly direction with respect to a door frame lacking installed hardware, the door engaging member including a plurality of planar surfaces including a first planar surface which is adapted to abut a stop of the door frame when the outwardly opening door is closed;

a threaded shaft adapted to be positioned on an opposite side of the door than the outwardly direction in which it opens, the threaded shaft having a first end pivotably attached to the door engaging member and a second end opposite the first end, the threaded shaft being manually pivotably movable between unlocked and locked positions;

a retaining nut disposed on the threaded shaft for axial movement between the first and second ends thereof;

a wedge member slidably arranged on the threaded shaft between the first end thereof and the retaining nut the wedge member being movable into a securing position, wherein the wedge member is adapted to be wedged between the retaining nut and the stop of the door frame for positionally constraining the outwardly opening door thereagainst and for preventing opening of the door from outside, when the threaded shaft is in the locked position, and being quickly releasable from the securing position, for rapidly opening the door from inside, when the threaded shaft is moved toward the unlocked position; and further comprising:

a cam member disposed on the first end of the threaded shaft; and a spring member attached to the door engaging member and cooperatively engaging the cam member for biasing the threaded shaft in the unlocked and locked positions, respectively, the threaded shaft being quickly movable from the unlocked and locked positions when a moment sufficient to overcome the biasing of the spring member is applied thereto.

2. A quick-release door locking device comprising:

a door engaging member adapted to be attached to a free-end of a door that opens in an outwardly direction with respect to a door frame lacking installed hardware, the door engaging member including a plurality of planar surfaces including a first planar surface which is adapted to abut a stop of the door frame when the outwardly opening door is closed;

a threaded shaft adapted to be positioned on an opposite side of the door than the outwardly direction in which it opens, the threaded shaft having a first end pivotably attached to the door engaging member and a second end opposite the first end, the threaded shaft being manually pivotably movable between unlocked and locked positions;

a retaining nut disposed on the threaded shaft for axial movement between the first and second ends thereof;

a wedge member slidably arranged on the threaded shaft between the first end thereof and the retaining nut, the wedge member being movable into a securing position, wherein the wedge member is adapted to be wedded between the retaining nut and the stop of the door frame for positionally constraining the outwardly opening door thereagainst and for preventing opening of the door from outside, when the threaded shaft is in the locked position, and being quickly releasable from the securing position, for rapidly opening the door from inside, when the threaded shaft is moved toward the unlocked position; and a cam member disposed on the first end of the threaded shaft; and a spring member attached to the door engaging member and cooperatively engaging the cam member for biasing the threaded shaft in the unlocked and locked positions, respectively, the threaded shaft being quickly movable from the unlocked and locked positions when a moment sufficient to overcome the biasing of the sprin member is applied thereto; and wherein the cam member has a generally rectangular parallelepiped configuration.

3. The door locking device of claim 1, wherein the threaded shaft forms an acute angle with respect to the first planar surface of the door engaging member when in the unlocked position, and forms an obtuse angle with respect to the first planar surface of the door engaging member when in the locked position.

4. The door locking device of claim 3, wherein the locked position of the threaded shaft is approximately perpendicular to the unlocked position of the threaded shaft.

5. The door locking device of claim 1, wherein the door engaging member is formed of metal.

6. The door locking device of claim 1, wherein the planar surfaces of the door engaging member are adapted to frictionally engage the free-end of the door.

7. The door locking device of claim 1, wherein the second end of the threaded shaft includes a knob handle for facilitating manual pivotal movement of the threaded shaft between the unlocked and locked positions.

8. The door locking device of claim 1, wherein the retaining nut is a wing nut.

9. A quick-release door locking device comprising:

a door engaging member attachable to a free-end of a door, the door engaging member including a first planar surface, a second planar surface arranged substantially parallel to the first planar surface, and a third planar surface arranged generally perpendicularly therebetween, the first planar surface being adapted to engage a stop of the door frame when the outwardly opening door is closed;

a threaded shaft having a first end pivotably mounted to the door engaging member and a second end opposite the first end, the threaded shaft being manually pivotably movable between an unlocked position, wherein the threaded shaft forms an acute angle with respect to the first planar surface of the door engaging member, and a locked position, wherein the threaded shaft forms an obtuse angle with respect to the first planar surface of the door engaging member;

a retaining nut disposed on the threaded shaft for axial movement between the first and second ends thereof;

a wedge member slidably arranged on the threaded shaft between the first end thereof and the retaining nut, the wedge member being movable into a securing position, wherein the wedge member is adapted to be wedged between the retaining nut and the stop of the door frame for preventing opening of the door from outside, when the threaded shaft is in the locked position, and being quickly releasable from the securing position, for rapidly opening the door from inside, when the threaded shaft is moved toward the unlocked position;

a cam member disposed on the first end of the threaded shaft; and a spring member attached to the door engaging member and cooperatively engaging the cam member for biasing, the threaded shaft in the unlocked and locked positions, respectively, the threaded shaft being quickly movable from the unlocked and locked positions when a sufficient moment is applied thereto.

10. The door locking device of claim 9, wherein the door engaging member is formed of metal and the planar surfaces thereof are adapted to frictionally engage the free-end of the door.

11. The door locking device of claim 9, wherein the third planar surface of the door engaging member includes a hole which is adapted to receive an optional fastener for facilitating attachment of the door engagement member to the free-end of the door.

12. The door locking device of claim 11, wherein the optional fastener is a screw.

13. A quick-release door locking device comprising:

a door engine member adapted to fit on a free-end of a door that opens in an outwardly direction with respect to a door frame devoid of installed hardware, the door engaging member including a plurality of planar surfaces including a first planar surface which is adapted to abut a stop of the door frame when the outwardly opening door is closed;

a shaft adapted to be positioned on an opposite side of the door than the outwardly direction in which it opens, the shaft having a first end pivotably mounted to the door engaging member and a second end opposite the first end, the shaft being manually pivotably movable between unlocked and locked positions; and a wedge member slidably arranged on the shaft and adapted to engage the stop of the door frame, for positionally constraining the outwardly opening door thereagainst and for preventing opening of the door from outside, when in a securing position, and being quickly releasable from the securing position, for rapidly opening the door from inside, when the shaft is moved toward the unlocked position; and further comprising:

a cam member disposed on the first end of the shaft; and a spring member attached to the door engaging member and cooperatively engaging the cam member for biasing the shaft in the unlocked and locked positions, respectively, the shaft being quickly movable from the unlocked and locked positions when a moment sufficient to overcome the biasing of the spring member is applied thereto.

* * * * *